US009779908B2

(12) United States Patent
Ding et al.

(10) Patent No.: US 9,779,908 B2
(45) Date of Patent: Oct. 3, 2017

(54) X-RAY GENERATOR WITH ADJUSTABLE COLLIMATION

(71) Applicants: Nuctech Company Limited, Haidian District, Beijing (CN); Tsinghua University, Haidian District, Beijing (CN)

(72) Inventors: Fuhua Ding, Beijing (CN); Zhiqiang Chen, Beijing (CN); Ziran Zhao, Beijing (CN); Wanlong Wu, Beijing (CN); Le Tang, Beijing (CN); Yingkang Jin, Beijing (CN); Yanjie Wen, Beijing (CN)

(73) Assignees: Nuctech Company Limited, Haidian District, Beijing (CN); Tsinghua University, Haidian District, Beijing (CN)

( * ) Notice: Subject to any disclaimer, the term of this patent is extended or adjusted under 35 U.S.C. 154(b) by 109 days.

(21) Appl. No.: 14/729,622

(22) Filed: Jun. 3, 2015

(65) Prior Publication Data

US 2015/0371809 A1 Dec. 24, 2015

(30) Foreign Application Priority Data

Jun. 6, 2014 (CN) ..... 2014 1 0250942

(51) Int. Cl.
*H01J 35/10* (2006.01)
*H01J 35/12* (2006.01)
(Continued)

(52) U.S. Cl.
CPC ..... *H01J 35/12* (2013.01); *G21K 1/043* (2013.01); *G21K 1/046* (2013.01); *H05G 1/12* (2013.01); *H01J 2235/1287* (2013.01)

(58) Field of Classification Search
CPC ..... G21K 1/04; G21K 1/046; G21K 1/02; G21K 1/025; G21K 1/043; H01J 35/12
(Continued)

(56) References Cited

U.S. PATENT DOCUMENTS 4,063,097 A * 12/1977 Barrett ..... A61B 6/032 378/18
4,726,046 A * 2/1988 Nunan ..... A61N 5/1042 250/492.1
(Continued)

FOREIGN PATENT DOCUMENTS

CN 103635002 A 3/2014
CN 203934087 U 11/2014
EP 2 701 159 A2 2/2014

OTHER PUBLICATIONS

Extended European Search Report for corresponding European Patent Application No. 15170759.3 dated Oct. 27, 2015.
(Continued)

*Primary Examiner* — Jason McCormack
(74) *Attorney, Agent, or Firm* — Merchant & Gould P.C.

(57) ABSTRACT

The present disclosure provides an X-ray generator with adjustable collimation. The X-ray generator comprises: an assembly of X-ray source, which includes an X-ray tube having a cathode and an anode and a front collimator; a high voltage generator, which is disposed in an extended chamber of a housing for the X-ray tube and which is used for supplying a direct current high voltage between the cathode and the anode of the X-ray tube to excite X-ray beams; a collimation adjustment unit, which is rotatably disposed outside of the front collimator and which is used for adjusting fan-type X-ray beams into continuous pencil-type X-ray beams; and a cooling unit, which is independently mounted to the X-ray tube and which is used for cooling the anode of the X-ray tube; wherein, the assembly of X-ray source, the
(Continued)

high voltage generator, the collimation adjustment unit and the cooling unit are integrated as a whole. The X-ray generator with adjustable collimation according to the disclosure has a compact construction, which is helpful in miniaturization, modularization and high efficiency of a security detection equipment.

16 Claims, 6 Drawing Sheets

(51) Int. Cl.
*G21K 1/04* (2006.01)
*H05G 1/12* (2006.01)

(58) Field of Classification Search
USPC ..... 378/119, 130, 141, 147, 145, 199, 200
See application file for complete search history.

(56) References Cited

U.S. PATENT DOCUMENTS 5,384,821 A * 1/1995 Jedlitschka ..... H05G 1/04 378/193
5,438,605 A * 8/1995 Burke ..... A61N 5/01 378/123
5,493,599 A * 2/1996 Mattson ..... A61B 6/032 378/147
6,288,597 B1 * 9/2001 Hasegawa ..... H03K 17/0828 327/403
6,778,635 B1 8/2004 Richardson
2005/0078798 A1 * 4/2005 Jiang ..... C03B 37/01214 378/147
2008/0043925 A1 2/2008 Sundaram
2009/0038865 A1 * 2/2009 Moriguchi ..... B60K 7/0007 180/55
2009/0310742 A1 12/2009 Kim et al.
2010/0111265 A1 * 5/2010 Holm ..... H01J 35/165 378/200
2010/0214736 A1 * 8/2010 Zhang ..... G06F 1/20 361/679.47
2011/0176745 A1 7/2011 Zamyatin et al.
2014/0064453 A1 3/2014 Safai
2014/0314197 A1 * 10/2014 Watanabe ..... H01J 35/12 378/4

OTHER PUBLICATIONS

Chinese Office Action for corresponding Chinese Patent Application No. 201410250942.5 dated Jan. 12, 2016.
European Office Action for corresponding European Patent Application No. 15170759.3 dated Nov. 2, 2016, 4 pages.

* cited by examiner

X-RAY GENERATOR WITH ADJUSTABLE COLLIMATION

CROSS-REFERENCE TO RELATED APPLICATION

This application claims the benefit of Chinese Patent Application No. 201410250942.5 filed on Jun. 6, 2014 in the State Intellectual Property Office of China, the whole disclosure of which is incorporated herein by reference.

BACKGROUND

Technical Field

The present disclosure relates to technical field of X-ray generators, and particularly to an X-ray generator with adjustable collimation and monolithic construction, which is adopted in X-ray radiating imaging-based security detection, medical treatment and scientific research, etc.

Description of the Related Art

Conventional X-ray generator usually includes parts such as a high-voltage power supply, an X-ray tube and a cooling unit, etc. These parts are relatively independent and are connected by cables and pipes. There are lots of intermediate parts and a large space is occupied. The emitted X-ray beams mostly present in a fan-type shape, and, these beams cannot be adjusted, or else, adjustment of these beams is difficulty and complicated. Especially, in terms of cooling and heat dissipation, common heat dissipation ways such as circulating oil cooling and circulating water cooling are easily susceptible to leakage and thereby are inconvenient in application.

At present, security detection apparatuses and medical treatment equipments are developed to be miniaturization, modularization and high efficiency. In order to achieve this objective, it is desired to provide an X-ray generator with adjustable collimation and monolithic construction.

SUMMARY

According to an aspect of the present disclosure, there is provided an X-ray generator with adjustable collimation, comprising:

- an assembly of X-ray source, which includes an X-ray tube having a cathode and an anode and a front collimator;
- a high voltage generator, which is disposed in an extended chamber of a housing for the X-ray tube and which is used for supplying a direct current high voltage between the cathode and the anode of the X-ray tube to excite X-ray beams;
- a collimation adjustment unit, which is rotatably disposed outside of the front collimator and which is used for adjusting fan-type X-ray beams into continuous pencil-type X-ray beams; and
- a cooling unit, which is independently mounted to the X-ray tube and which is used for cooling the anode of the X-ray tube;
- wherein, the assembly of X-ray source, the high voltage generator, the collimation adjustment unit and the cooling unit are integrated as a whole.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION OF THE EMBODIMENTS

Figure 1:
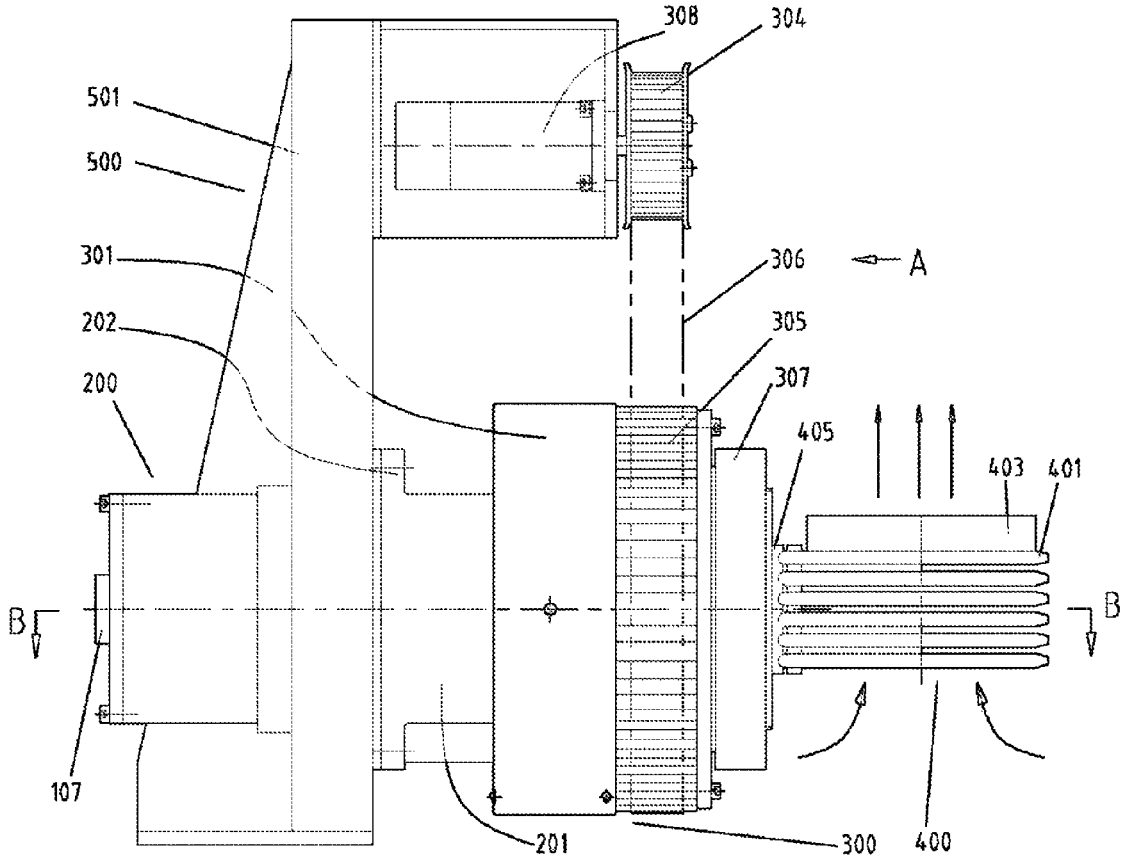
FIG. 1 is a front view of an X-ray generator with adjustable collimation according to an embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An object of the present disclosure is to provide an X-ray generator with adjustable collimation and monolithic construction, in order to meet the demand of miniaturization, modularization and high efficiency of an X-ray radiation imaging apparatus.

FIG. 1 shows an overall structure of an X-ray generator with adjustable collimation according to an embodiment of the present disclosure. The X-ray generator mainly comprises an assembly of X-ray source 200, a collimation adjustment unit 300, a driving pulley 304, a driven pulley 305, a transmission belt 306, a servo motor 308, a cooling unit 400, a fixing mount 501, and an anti-oil navigation base 107.

Core parts including the assembly of X-ray source 200, the collimation adjustment unit 300 and the cooling unit 400, etc., are combined as a monolithic construction and are integrated into a housing 201 for X-ray tube. Rotation movement of the collimation adjustment unit 300 is driven by the servo motor 308 through the driving pulley 304, the transmission belt 306 and the driven pulley 305. The fixing mount 501 is used for mounting the housing 201 for X-ray tube, the servo motor 308 and other components thereon and is formed with corresponding mounting holes. Systemically electrical and automatic control functions are achieved through the anti-oil navigation base 107.

Figure 2:
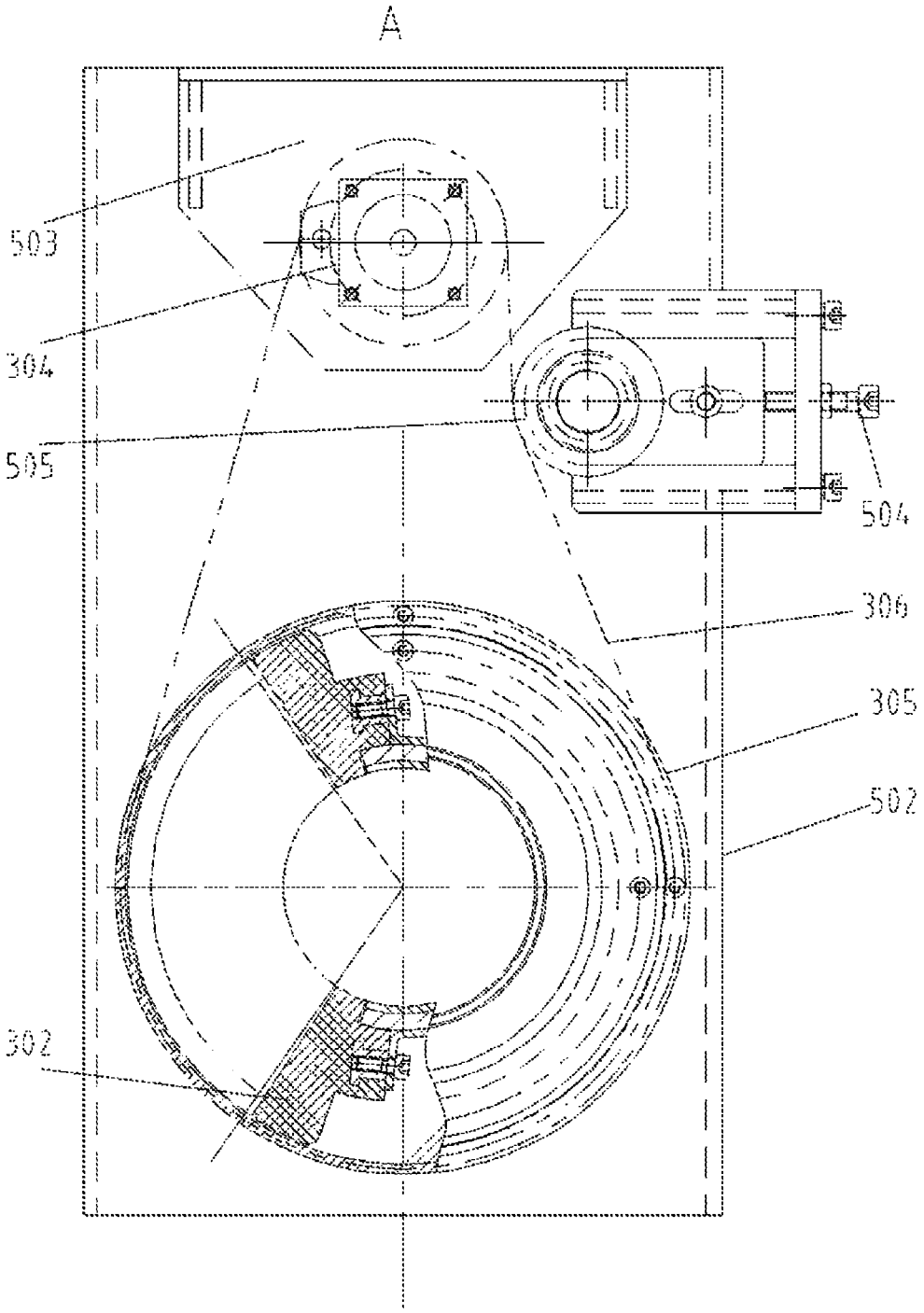
FIG. 2 is a view seen along an A direction in FIG. 1.
Figure 3:
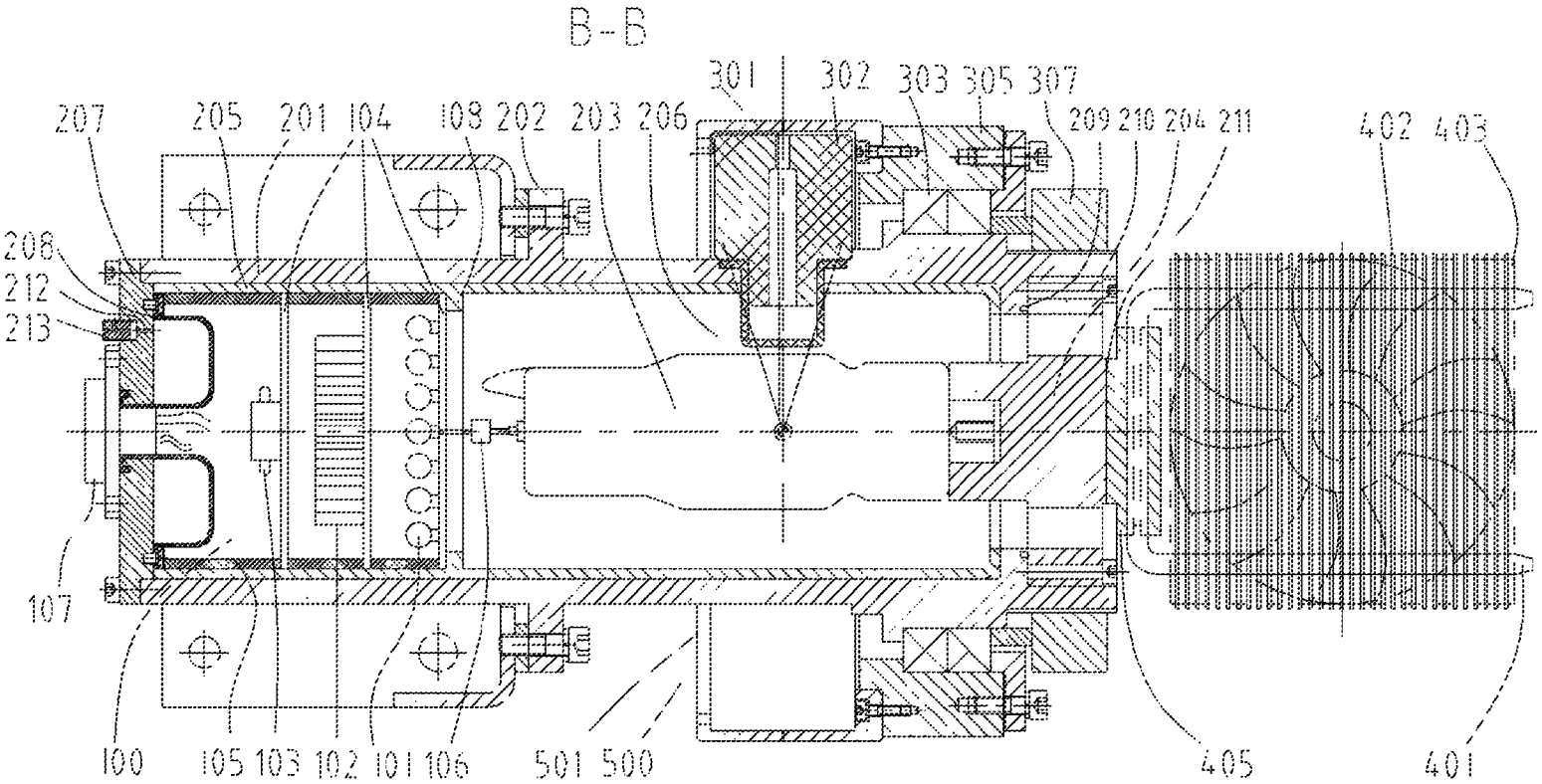
FIG. 3 is a sectional view along line B-B in FIG. 1.

According to an embodiment, referring to FIGS. 1-3, the X-ray generator with adjustable collimation, comprises the assembly of X-ray source 200, the collimation adjustment unit 300, a high voltage generator 100 and a cooling unit 400, wherein the assembly of X-ray source 200, the high voltage generator 100, the collimation adjustment unit 300 and the cooling unit 400 are integrated as a whole. Specifically, the assembly of X-ray source 200 includes an X-ray tube having a cathode and an anode and a front collimator 302. The high voltage generator 100 is disposed in an extended chamber of the housing 201 for X-ray tube and is for supplying with a direct current high voltage between the cathode and the anode of the X-ray tube to excite X-ray beams. The collimation adjustment unit 300 is rotatably disposed outside of the front collimator 302 and is used for adjusting fan-type X-ray beams into continuous pencil-type X-ray beams. The cooling unit is independently mounted to the X-ray tube and is used for cooling the anode of the X-ray tube.

Referring to FIGS. 1-2, the front collimator 302 may be made of bismuth oxide and has a high voltage insulation function and a radiation protection function. It is low in cost, light in weight and easy to be manufactured, and also meets the environmental requirements. The front collimator 302 is secured to the outside of the front collimator 302 by an arc hoop.

Referring to FIG. 3, the assembly of X-ray source further comprises a heat radiating base 204 for the anode, which base is disposed at an anode side of the X-ray tube, and an end cover 207 and a tympan 208, which are disposed at a cathode side of the X-ray tube and which co-operatively work to provide seal and leakage prevention. When the X-ray tube 203 emits the beams continuously, the temperature of insulating oil goes up and the volume thereof undergoes a certain amount of expansion. Conversely, when the temperature goes down, the tympan 208 is squeezed from outside to inside under the action of atmospheric pressure. The tympan 208 is attached on the inside of the cathode and is concurrently acted as a seal ring.

Figure 7:
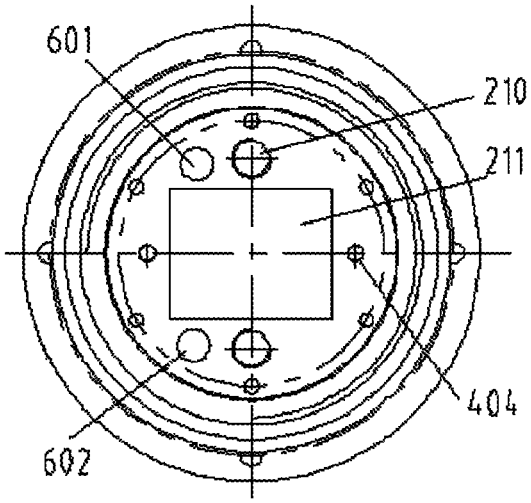
FIG. 7 is a schematic view of a heat-transfer surface of the X-ray generator shown in FIG. 1.

Optimally, the heat radiating base 204 for the anode may be embedded with a temperature sensor 601 and a temperature switch 602 therein. Referring to FIG. 7, the heat radiating base 204 for the anode of the X-ray tube is embedded therein with the temperature sensor 601 that is used for monitoring, in real-time, a working temperature of the X-ray tube 203, and the temperature switch 602 is able to promptly provide a fault signal once the temperature goes beyond an allowable threshold, for safety protection of apparatuses.

Referring to FIGS. 1-3, the X-ray generator may further comprise the cooling unit 400, which is independently mounted to the X-ray tube and which is used for cooling the anode of the X-ray tube. Specifically, the heat radiating base 204 has a heat-transfer surface 211 for contacting with the cooling unit 400, in order for the cooling. The cooling unit may comprise a heat radiating plate 405 and heat tubes 401 disposed on the heat radiating plate 405, and the heat radiating plate 405 sufficiently contacts with the heat-transfer surface 211 of the heat radiating base 204 via thermal conduction silicon grease. Alternatively, the cooling unit 400 may comprise only the heat tubes 401 directly clamped and fixed to the heat-transfer surface 211 of the heat radiating base 204. In addition, the cooling unit 400 may further comprise heat radiating fins 402 which are disposed on the heat tubes 401 and a silent fan 403 which is disposed above the heat radiating fins 402. The heat tube 401 may be in a U-type configuration or in an L-type configuration.

Referring to FIGS. 1 and 3, the cooling unit 400 is used for taking away the heat from the anode of the X-ray tube 203 and includes the heat radiating base 204 for the anode, the heat tubes 401, the heat radiating fins 402, the silent fan 403 and the heat radiating plate 405. The heat tubes 401 are independent from each other, and each has its certain strength and is curved in a U-type configuration. Several U-type heat tubes are mounted on the heat radiating plate 405. The heat radiating fins 402 are welded around the heat tubes 401, in order to increase the heat radiating area. The silent fan 403 is secured in a snap fitting way. The above-mentioned structure is wholly mounted on the heat radiating base 204 of the X-ray tube.

Referring to FIGS. 3 and 7, the heat-transfer surface 211 on the outside of the heat radiating base 204 for the anode is finished. The finished heat-transfer surface 211, together with a surface of the heat radiating plate 405, is clean and undamaged and is evenly coated with a layer of good thermal conduction silicon grease in order to ensure that the heat radiating plate 405 sufficiently contacts with the heat-transfer surface 211 of the heat radiating base via the thermal conduction silicon grease, thereby facilitating to quicken the heat radiation.

Referring to FIGS. 1 and 3, the silent fan 403 is disposed above the heat radiating fins 402 and performs a vertically upward air suction. In accordance with thermal convection principle that warmer air rises and cooler air falls, there generates a smooth air channel along an arrow shown in FIG. 1. This heat radiating configuration is independently assembled, which reduces system fault points and which is small and exquisite, environmentally-friendly, stable and convenient, and low in cost.

Referring to FIG. 3, the heat radiating base 204 for the anode of X-ray tube may be made of oxygen-free copper material, which is not only able to take away the heat quickly, but also is used as an end cover for sealing the anode within the housing 201 of the X-ray tube. A seal ring 209 for the heat radiating base 204 may be made of oxygen-free copper material, which avoids damage of conventional rubber seal ring due to overheat. The seal ring 209 is also formed with vacuum oil holes 210 therein, in order to ensure performance of the insulating oil inside.

Referring to FIG. 3, the heat radiating base 204 is of a relatively large size in whole and has a laterally extended end that increases heat capacity and heat radiating area. Alternatively, the heat tubes may be clamped and secured directly onto the heat radiating base 204.

According to an embodiment, referring to FIGS. 1 and 3, the X-ray generator further comprises the high voltage generator 100, which is disposed in the extended chamber of the housing 201 for X-ray tube and which is used for supplying with a direct current high voltage between the cathode and the anode of the X-ray tube to excite X-ray beams. As shown in FIG. 3, the high voltage generator 100 is distributed within the extended chamber of the housing 201 for X-ray tube. The housing 201 for X-ray tube is secured to the fixing mount 501 through an assembly boss 202. Direct current high voltage output is connected to the cathode of the X-ray tube 203 through a high voltage connector 106.

Specifically, the X-ray tube 203 is communicated with the extended chamber and is filled with insulating oil therein. Referring to FIG. 3, the housing 201 for X-ray tube is filled with high pressure insulating oil therein. A vent opening 212 with internal thread is formed in the housing 201, and a protective bolt 213 with L-type through hole therein is assembled in the vent opening. Through the L-type through hole, pressure balance between the inside of the housing 201 and the external environment is obtained. Once an oil leakage fault occurs, the protective bolt 213 is screwed into the vent opening 212 such that L-type through hole is blocked, preventing leakage of the insulating oil.

Referring to FIG. 3, a concave filter cover 206 may be made of polycarbonate, is used to restrict a thickness of an oil layer at a beam port of the X-ray tube 203, and itself has well X-ray penetrability, enhancing effective output dose of the X-ray.

Figure 4:
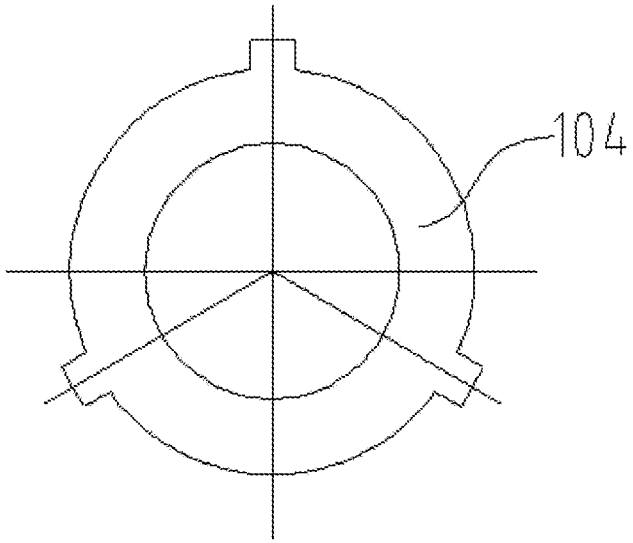
FIG. 4 is a layout view of a high voltage circuit in the X-ray generator shown in FIG. 1.

Referring to FIGS. 3 and 4, the high voltage generator 100 comprises an annular high voltage circuit 101, a high voltage transformer 102 and a filament transformer 103 disposed within the extended chamber. The annular high voltage circuit 101, the high voltage transformer 102 and the filament transformer 103 are respectively located on corresponding insulating resin plates 104 and are disposed at sides of the corresponding insulating resin plates 104 away from the X-ray tube. In one embodiment, the insulating resin plate 104 is embodied as a circular insulating resin plate having a hollow portion through which the insulating oil passes and a peripheral portion provided with a plurality of protruded fixing supports.

Referring to FIGS. 3 and 4, the high voltage circuit 101 has an annular layout, an R-type magnetic core is used as the high voltage transformer 102, a UY-type magnetic core is used as the filament transformer 103, and all the mentioned three components are secured at sides of the circular insulating resin plates 104 facing in the same direction. Three protruded fixing supports are provided at the peripheral portion of each of the resin plates 104, and the central portion is hollowed such that the insulating oil passes therethrough.

Figure 5:
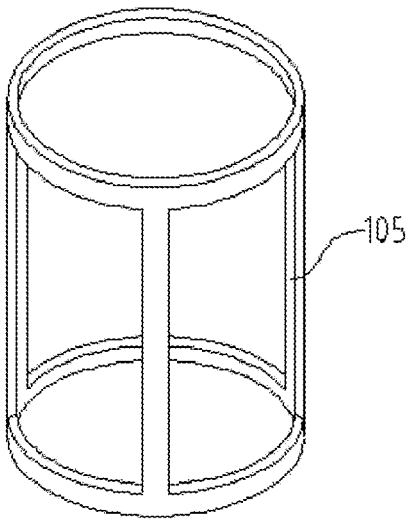
FIG. 5 is a schematic view of a positioning spacer of the X-ray generator shown in FIG. 1.

Moreover, the high voltage generator 100 further comprises a caged positioning spacer 105 fixedly arranged within the extended chamber, the insulating resin plates 104 are fixedly positioned within the extended chamber through the caged positioning spacer 105. Referring to FIGS. 3 and 5, the three annular insulating resin plates 104 are located in position by the caged positioning spacer 105.

Specifically, the collimation adjustment unit 300 comprises a rotary Tungsten ring 301 for adjustment purpose, and a drive mechanism for driving a rotation of the rotary Tungsten ring around the front collimator to achieve a X-ray pointwise continuous scanning. The drive mechanism comprises a motor 308 mounted on the fixing mount 501, a driving pulley 304 connected to the motor 308, a driven pulley 305 connected to the rotary Tungsten ring 301, and a transmission belt 306 connected between the driving pulley 304 and the driven pulley 305.

Referring to FIG. 3, the assembly of X-ray source 200 and the collimation adjustment unit 300 comprise the housing 201 for X-ray tube, the assembly boss 202, a radiation protection lining 205, the X-ray tube 203 and heat radiating base 204 for the anode thereof, the oxygen-free copper seal ring 209, the concave filter cover 206, the end cover 207 and the tympan 208 for sealing of the cathode, the rotary Tungsten ring 301, the driven pulley 305, a lock nut 307, a front collimator 302, an angular contact bearing 303 and the anti-oil navigation base 107.

Referring to FIGS. 1-3, a driving source for rotation of the Tungsten ring 301 is the servo motor 308 mounted on a motor frame 503, the driving pulley 304 is tightly bound around a driving shaft of the servo motor 308 by an expansion sleeve, and, through the transmission belt 306, drives the driven pulley 305 to rotate, and, the driving pulley 304 and the driven pulley 305 meets a certain drive ratio relationship.

Referring to FIGS. 2 and 3, the rotary Tungsten ring 301 is formed with several small throughholes therein, fits over the front collimator 302 and is fixed onto the driven pulley 305 by screws. The angular contact bearing 303 is fit around the outer surface of the housing 201 for X-ray tube, is tightly attached to a stop boss and locked by the lock nut 307. The driven pulley 305 is mounted outside of the angular contact bearing 303. the rotary Tungsten ring is driven by the servo motor 308 to rotate around the front collimator 302, achieving dynamic scanning of the pencil-type beam X-ray. The rotary and radiation protection unit is smart in structure, low in power consumption, and small in noise.

Referring to FIG. 3, the pencil-type beam X-ray adjusted by the rotary Tungsten ring 301 has good spot characteristic and small penumbral effect, facilitating to improve the image resolution.

In addition, the drive mechanism may further comprise a tensioning structure for adjusting degree of tightness of the transmission belt 306. As shown in FIGS. 1 and 2, the degree of tightness of the transmission belt 306 may be adjusted by the servo motor 308 through mechanisms such as top screw 504, tensioning wheel, etc.

According to an embodiment, the X-ray generator may further comprise a mechanical mounting unit 500, and the assembly 200 of X-ray source, the high voltage generator 100, the collimation adjustment unit 300 and the cooling unit 400 are supported at a fixing mount 501 of the mechanical mounting unit 500.

According to an embodiment, the X-ray generator may further comprise a radiation protection unit consisted of a radiation protection layer 205, the front collimator 302 and the rotary Tungsten ring 301 disposed within the X-ray tube and the extended chamber.

Referring to FIGS. 3 and 5, a positioning boss 108 is formed in a ring shape on an inner side of the radiation protection lead layer 205. The three annular insulating resin plates 104 are located in position by the caged positioning spacer 105.

Figure 6:
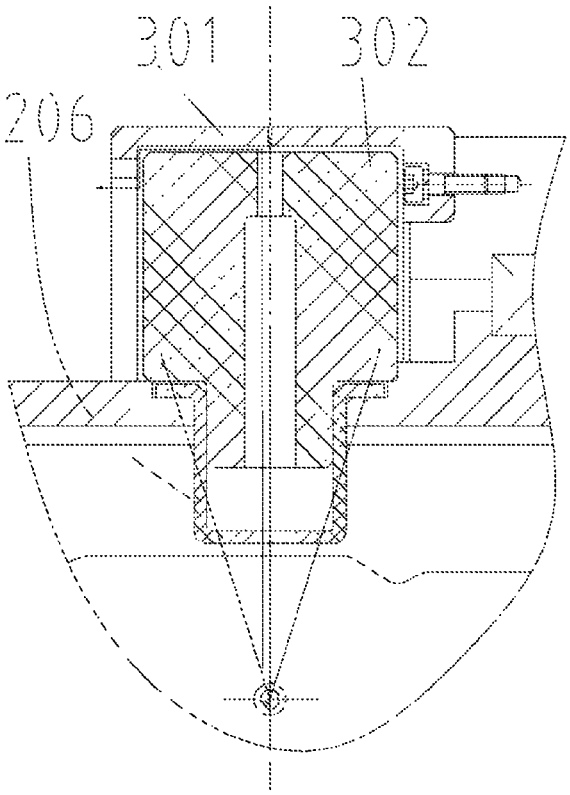
FIG. 6 is a schematic view of a Labyrinth radiation protection unit of the X-ray generator shown in FIG. 1.

Referring to FIGS. 3 and 6, the front collimator 302 is a front collimator made of heavy metal oxide. The front collimator 302 has a certain thickness and flare angle characteristic, to restrict the X-ray beams within the fan-type port. The rotary Tungsten ring 301 is equipped with guard ribs at both sides thereof and fits around the front collimator 302 with a clearance of about 1 mm therebetween. Besides passing through the small throughholes in the Tungsten ring, all of the X-rays only pass along the release path shown in FIG. 2. The inner protection layer of the housing 201 for X-ray tube, the front collimator 302 and the rotary Tungsten ring 301 together constitute an effectively Labyrinth radiation protection unit for preventing leakage of the X-ray to meet safety requirements.

Figure 8:
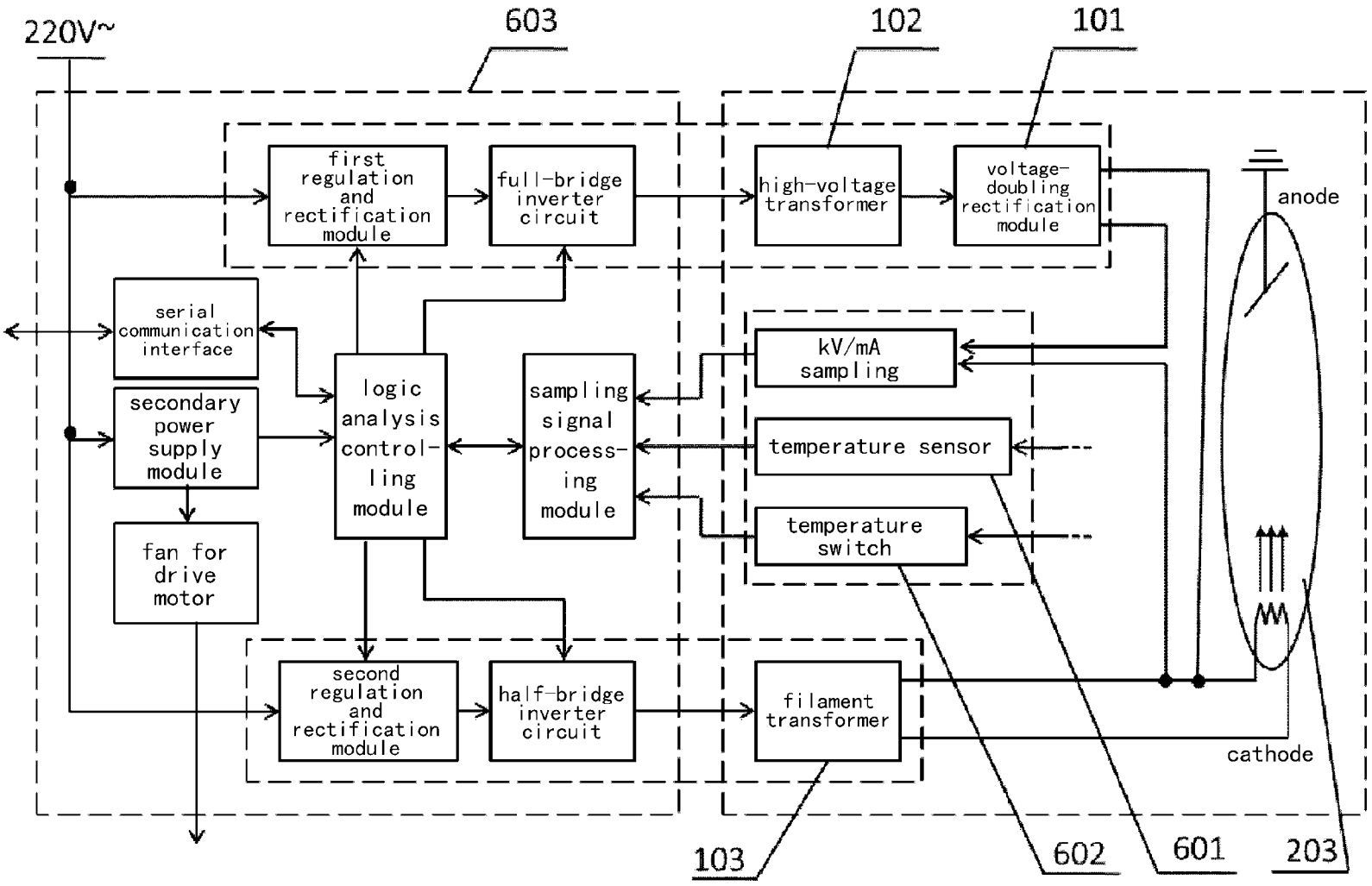
FIG. 8 is a schematic diagram of a high voltage source of the X-ray generator shown in FIG. 1.

Referring to FIG. 8, electrical current from power supply passes through a first regulation and rectification module and then is outputted through a full-bridge inverter circuit to the high-voltage transformer 102, so as to achieve an initial voltage boost. Then, it is input into a voltage-doubling rectification module 101, to achieve a high negative pressure. Finally, it is applied onto the cathode of the X-ray tube 203. Electrical current from power supply passes through a second regulation and rectification module and then is outputted through a half-bridge inverter circuit to a primary side of the filament transformer 103, while a secondary side of the filament transformer 103 is connected to both ends of the filament of the cathode of the X-ray tube 203. An inversion and control module 603 is connected with the navigation base 107 such that, when a high voltage is applied across both ends of the X-ray tube 203, accelerated hot electrons are generated to impact against the anode target to generate X-ray beams.

Accordingly, the abovementioned X-ray generator comprises the high voltage generator which applies a voltage across both ends of the X-ray tube, the assembly of X-ray source which includes the front collimator and the radiation protection unit, the rotary collimation adjustment unit which is used to adjust the X-ray, the heat tube cooling unit for cooling the anode of the X-ray tube, and the mechanical mounting unit for providing supports and fixations. The high voltage generator is disposed within the extended chamber of the housing for the X-ray tube, and the cooling unit is independently mounted. All the abovementioned parts are integrated into a compact and monolithic construction.

That is, the X-ray generator with adjustable collimation according to embodiments of the present disclosure comprises the high voltage generator, the assembly of X-ray source, the collimation adjustment unit, the cooling unit and the mechanical mounting unit, which are integrated as a whole. Accordingly, it has a combined monolithic construction, adopts the heat tube cooling and adjusts the fan-type X-ray beams into continuous pencil-type X-ray beams by using of the front collimator and the rotary collimation adjustment unit, achieving dynamic pointwise scanning on an object to be checked.

According to the abovementioned embodiments, the high voltage generator supplies a direct current high voltage between the cathode and the anode of the X-ray tube such that high energy electrons generated at the cathode impacts the anode to emit the X-ray beams. The high voltage generator is disposed within the extended chamber of the housing for X-ray tube such that it is integrally formed with the assembly of X-ray source, with pure transformer insulating oil filled within the housing.

According to the abovementioned embodiments, a UY-type ferrite magnetic core may be used as the filament transformer, an R-type ferrite magnetic core, which is low in stray flux and leakage inductance and high in magnetic permeability, may be used as the high voltage transformer, the high voltage circuit is of an annular layout, and high voltage output is achieved in a multistage rectification voltage-multiplying way. The filament transformer, the high voltage transformer and the high voltage circuit are disposed at sides of the insulating resin plates facing in the same one direction. Three protruded fixing supports are provided at the peripheral portion of each of the resin plates, and the central portion is hollowed such that the insulating oil passes therethrough. An annular positioning boss is formed on an inner side of the radiation protection lead layer. The three annular insulating resin plates are located in position by the caged positioning spacer. Direct current high voltage output is connected to the X-ray tube through a connector. The control system is connected through an anti-oil navigation connector.

According to the abovementioned embodiments, the assembly of X-ray source comprises the cylindrical housing for the X-ray tube, the assembly boss, the heat radiating base for the anode of the X-ray tube, the radiation protection layer, the filter cover made of polycarbonate, the end cover for sealing the cathode, the vacuum oil holes and the tympan, etc. The heat radiating base for the anode is used as an end seal cover and has a finished and slightly protruding slightly heat-transfer surface. The anode-side seal ring is made of oxygen-free copper material, which avoids deformation caused by overheat. The seal ring 209 is also formed with vacuum oil holes 210 thereon, in order to ensure performance of the insulating oil inside. Concave filter cover is made of polycarbonate, and is used to restrict a thickness of an oil layer at a beam port of the X-ray tube and itself has well X-ray penetrability, enhancing effective output dose of the X-ray. The housing for the X-ray tube has a fan-type port of certain angle in accordance with flare angle characteristics of the X-ray tube such that the X-ray beams are effectively generated once direct current high voltage is applied across both ends of the X-ray tube.

According to the abovementioned embodiments, the heat radiating base for the anode is made of oxygen-free copper material, which not only is of a relatively large size in whole, but also has a laterally extended end that increases heat capacity and heat radiating area. In addition, it is also used as an end cover for sealing the anode within the housing for X-ray tube.

According to the abovementioned embodiments, the end cover for sealing the cathode is cooperated with a flexible tympan to create a chamber therebetween. During operation of the X-ray generator, the insulating oil is expanded when being heated, and contracted when being cooled, correspondingly, the tympan will be squeezed from the insulating oil side or from the ambient environment side. Here, a vent opening formed in the end cover for the cathode is used to act as a release channel so as to obtain a pressure balance. The vent opening is formed with internal thread therein, and a protective bolt with a through hole therein is assembled in the vent opening. Once an oil leakage fault occurs, the protective bolt is screwed into the vent opening such that the through hole is blocked, preventing leakage of the insulating oil. In addition, the tympan and the end cover together work as a sealing ring.

According to the abovementioned embodiments, the collimation adjustment unit comprises rotary Tungsten ring, front collimator, angular contact bearing, driving pulley, driven pulley, transmission belt, lock nut and servo motor. The rotary Tungsten ring is formed with several small throughholes therein and is fixed onto the driven pulley. The front collimator is fixedly bound around the outer surface of the housing for the X-ray tube. The angular contact bearing is embedded inside the driven pulley and is braced around the outer surface of the housing for the X-ray tube while being locked by the lock nut. Under the action of the servo motor 308, the driven pulley is driven by the driving pulley and brings the angular contact bearing to rotate, here, the Tungsten ring is driven to be rotated around the front collimator, achieving X-ray pointwise continuous scanning. The mentioned collimation adjustment unit is simplified in structure, low in power consumption, and small in noise, and has good spot characteristics, reduced penumbral effect and improved image resolution.

According to the abovementioned embodiments, the front collimator has certain thickness and is embedded within the concave filter cover made of polycarbonate. The front collimator is made of heavy metal oxide, bismuth oxide, which is easily machined, has high voltage insulation and radiation protection characteristic, and also meets the environmental requirements. Other materials, such as lead oxide, may be used. The Tungsten ring is equipped with guard ribs at both sides thereof and owns good radiation protection effect. The inner protection layer of the housing for the X-ray tube, the front collimator and the rotary Tungsten ring together constitute an effectively Labyrinth radiation protection unit, preventing leakage of the X-ray so as to meet safety requirements.

According to the abovementioned embodiments, the cooling unit adopts heat radiation via heat tube and is consisted of heat tubes, fixed clamping plates, thermal conductive substrate, heat radiating fins and silent fan. In order to avoid target ablation due to overheat of the anode of the X-ray tube, heat tube, which is an efficient heat conductor that transfers heats by means of evaporation and condensation of liquid within fully enclosed vacuum tube, is used. Generally, it has an L-type configuration. The evaporation end of the heat tube is fixed by the thermal conductive substrate and is configured to sufficiently contacted with the slightly protruding heat-transfer surface of the heat radiating base, while the condensation end is welded with a plurality of layers of large-sized heat radiating fins. The silent fan, together with the suction fan mounted above the radiation protection unit, takes away the hot air and brings sucks the cool air, which forms a smooth air channel, thereby taking away the heats generated at the anode quickly and effectively. That is, the cooling unit consisted of heat tubes is smart in structure, small in cost, stable in operation, easy to maintenance, and has a low power consumption, reduced fault points, and an novel and practicable effect.

Alternatively, the heat tubes may be directly secured to the heat radiating base for the anode.

According to the abovementioned embodiments, the mechanical mounting unit is provided to integrate these abovementioned functional units together into a monolithic construction. The mechanical mounting unit comprises fixing mount, outer radiation protection unit, frame for the motor, fastening screw, expansion sleeve, etc. The fixing mount is used to assemble the housing for the X-ray tube and its peripheral components together and is provided externally with the radiation protection unit, achieving the modularization. The mechanical mounting unit is processed with good processing technology and precision, in order to ensure well spot characteristics of the adjusted X-ray beams and assembled effect.

In addition, the X-ray generator according to the embodiments may further comprise minitype temperature switch and temperature sensor embedded within the heat radiating base for the anode, inverter circuit controlling module, related electrically controlling interface, proximity switch, etc.

Accordingly, the X-ray generator according to the embodiments has the following advantages. Firstly, the high voltage generator is incorporated into the inside of the housing for the X-ray tube, and, the high voltage generator, the assembly of X-ray source, the collimation adjustment unit and the cooling unit are integrated as a compact and monolithic construction, facilitating miniaturization, modularization and high efficiency of the X-ray security detection apparatuses and achieving a novel and practicable l design. Secondly, the X-ray beams are adjustable to continuous pencil-type X-ray beams for dynamic scanning, achieving well spot characteristics and small penumbra effect and improved image resolution. Thirdly, the cooling unit consisted of heat tubes which are independently assembled, works in cooperation with effective design of air channel, achieving a clean and stable configuration and reduction of system faults.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An X-ray generator with adjustable collimation, comprising:

an assembly of X-ray source, which includes an X-ray tube having a cathode and an anode and a front collimator;

a high voltage generator, which is disposed in an extended chamber of a housing for the X-ray tube and which is used for supplying a direct current high voltage between the cathode and the anode of the X-ray tube to excite X-ray beams;

a collimation adjustment ring, which is rotatably disposed outside of the front collimator and which is adapted to rotate about the X-ray source and adjust fan-type X-ray beams into continuous scanning pencil-type X-ray beams; and a cooling unit, which is independently mounted to the X-ray tube and which is used for cooling the anode of the X-ray tube;

wherein, the assembly of X-ray source, the high voltage generator, the collimation adjustment unit and the cooling unit are integrated as a whole, and wherein the high voltage generator comprises an annular high voltage circuit, a high voltage transformer and a filament transformer disposed within the extended chamber, wherein the annular high voltage generator, the high voltage transformer and the filament transformer are respectively located on corresponding insulating resin plates and are disposed at sides of the corresponding insulating resin plates away from the X-ray tube.

2. The X-ray generator according to claim 1, wherein the assembly of X-ray source further comprises:

a heat radiating base for the anode, which base is disposed at a side of the anode of the X-ray tube; and an end cover and a tympan, which are disposed at a side of the cathode of the X-ray tube and which co-operatively work to provide seal and leakage prevention.

3. The X-ray generator according to claim 2, wherein the heat radiating base has a heat-transfer surface for contacting with the cooling unit so as to be cooled.

4. The X-ray generator according to claim 3, wherein the cooling unit comprises a heat radiating plate and a heat tube disposed on the heat radiating plate, and the heat radiating plate is configured to sufficiently contact with the heat-transfer surface of the heat radiating base via thermal conduction silicon grease.

5. The X-ray generator according to claim 3, wherein the cooling unit comprises a heat tube directly mounted to the heat-transfer surface of the heat radiating base.

6. The X-ray generator according to claim 5, wherein the cooling unit further comprises:

heat radiating fins, which are disposed on the heat tube; and a silent fan, which is disposed above the heat radiating fins.

7. The X-ray generator according to claim 5, wherein the heat tube is in a U-type configuration.

8. The X-ray generator according to claim 2, wherein the heat radiating base is embedded with a temperature sensor and a temperature switch therein.

9. The X-ray generator according to claim 1, wherein the X-ray tube communicates with the extended chamber and is filled with insulating oil therein.

10. The X-ray generator according to claim 1, wherein the insulating resin plate is embodied as an annular insulating resin plate having a hollow portion through which the insulating oil passes and a peripheral portion provided with a plurality of protruded fixing supports.

11. The X-ray generator according to claim 1, wherein the high voltage generator further comprises a caged positioning spacer fixedly arranged within the extended chamber, the insulating resin plates being fixedly positioned within the extended chamber through the caged positioning spacer.

12. The X-ray generator according to claim 1, further comprising a mechanical mounting unit at which the assembly of X-ray source, the high voltage generator, the collimation adjustment unit and the cooling unit are supported.

13. The X-ray generator according to claim 12, wherein the collimation adjustment unit comprises:

a rotary Tungsten ring for adjustment purpose; and a drive mechanism for driving rotation of the rotary Tungsten ring around the front collimator to achieve a X-ray pointwise continuous scanning, wherein the drive mechanism comprises:

a motor mounted on the mechanical mounting unit;

a driving pulley connected to the motor;

a driven pulley connected to the rotary Tungsten ring; and a transmission belt connected between the driving pulley and the driven pulley.

14. The X-ray generator according to claim 13, wherein the drive mechanism further comprises a tensioning structure for adjusting degree of tightness of the transmission belt.

15. The X-ray generator according to claim 1, further comprising a radiation protection unit consisted of a radiation protection layer, the front collimator and the rotary Tungsten ring disposed within the X-ray tube and the extended chamber.

16. The X-ray generator according to claim 1, wherein the front collimator comprises a front collimator of heavy metal oxide.

* * * * *